US009016819B2

(12) United States Patent
Ono

(10) Patent No.: US 9,016,819 B2
(45) Date of Patent: Apr. 28, 2015

(54) IMAGE FORMING APPARATUS, DROPLET DISCHARGE DETECTING METHOD IN THE IMAGE FORMING APPARATUS, AND COMPUTER PROGRAM PRODUCT

(75) Inventor: Yasukazu Ono, Kanagawa (JP)

(73) Assignee: Ricoh Company, Limited, Tokyo (JP)

( * ) Notice: Subject to any disclaimer, the term of this patent is extended or adjusted under 35 U.S.C. 154(b) by 489 days.

(21) Appl. No.: 13/404,301

(22) Filed: Feb. 24, 2012

(65) Prior Publication Data

US 2012/0223991 A1 Sep. 6, 2012

(30) Foreign Application Priority Data

Mar. 3, 2011 (JP) ..... 2011-046500

(51) Int. Cl.
*B41J 29/38* (2006.01)
*B41J 2/045* (2006.01)
*B41J 2/165* (2006.01)

(52) U.S. Cl.
CPC ..... *B41J 2/04581* (2013.01); *B41J 2/0451* (2013.01); *B41J 2/04561* (2013.01); *B41J 2/16579* (2013.01); *B41J 2/16588* (2013.01); *B41J 2202/21* (2013.01)

(58) Field of Classification Search
CPC .. B41J 2/04561; B41J 2/0451; B41J 2/16579; B41J 2/16588; B41J 2/04581; B41J 2202/21
USPC ..... 347/14, 19, 29; 356/342
See application file for complete search history.

(56) References Cited

U.S. PATENT DOCUMENTS

| | | | | |
|---|---|---|---|---|
| 6,513,900 | B2 * | 2/2003 | Endo et al. | 347/19 |
| 6,592,199 | B2 | 7/2003 | Endo | |
| 8,485,633 | B2 | 7/2013 | Ito et al. | |
| 2004/0196319 | A1 | 10/2004 | Aruga | |

(Continued)

FOREIGN PATENT DOCUMENTS

| | | | |
|---|---|---|---|
| CN | 101372168 | A | 2/2009 |
| JP | 2004-223829 | A | 8/2004 |

(Continued)

OTHER PUBLICATIONS

Copending U.S. Appl. No. 13/410,852.*

(Continued)

*Primary Examiner* — Julian Huffman
*Assistant Examiner* — Carlos A Martinez
(74) *Attorney, Agent, or Firm* — Harness, Dickey & Pierce

(57) ABSTRACT

An image forming apparatus includes: a droplet discharging head that includes nozzle rows; a light emitting unit that irradiates a droplet with laser light emitted in a direction intersecting a discharging direction of the droplet; a light-receiving unit that receives scattered light scattered when the droplet is irradiated by the laser light and outputs a signal corresponding to an amount of the scattered light; and a droplet discharge detecting unit that detects a droplet discharging status of the nozzles based on the signal. The laser light is emitted with an optical axis shifted from middle between two adjacent nozzle rows; and the droplet discharge detecting unit selects two nozzles adjacent in a direction intersecting the nozzle rows as detection target nozzles, and detects the droplet discharging status of the detection target nozzles based on the scattered light scattered when droplets are simultaneously discharged from the detection target nozzles.

15 Claims, 8 Drawing Sheets

(56) References Cited

U.S. PATENT DOCUMENTS

| | | | | |
|---|---|---|---|---|
| 2005/0146550 | A1 | 7/2005 | Kusakari | |
| 2005/0253890 | A1* | 11/2005 | Nagashima | 347/19 |
| 2006/0158477 | A1 | 7/2006 | Kusakari et al. | |
| 2009/0058897 | A1 | 3/2009 | Han et al. | |
| 2009/0058921 | A1* | 3/2009 | Habashi | 347/29 |
| 2011/0026025 | A1* | 2/2011 | Govyadinov et al. | 356/342 |

FOREIGN PATENT DOCUMENTS

| | | | |
|---|---|---|---|
| JP | 2006-110964 | A | 4/2006 |
| JP | 2007-296670 | A | 11/2007 |
| JP | 2007296670 | * | 11/2007 |
| JP | 4645812 | B2 | 12/2010 |
| WO | WO-2010082516 | A1 | 7/2010 |

OTHER PUBLICATIONS

English language abstract for JP 2006-192789 corresponds to JP 4645812.

Chinese Office Action dated Jan. 6, 2014 issued in corresponding Chinese Application No. 201210054796.X (with English Translation).

* cited by examiner

IMAGE FORMING APPARATUS, DROPLET DISCHARGE DETECTING METHOD IN THE IMAGE FORMING APPARATUS, AND COMPUTER PROGRAM PRODUCT

CROSS-REFERENCE TO RELATED APPLICATIONS

The present application claims priority to and incorporates by reference the entire contents of Japanese Patent Application No. 2011-046500 filed in Japan on Mar. 3, 2011.

BACKGROUND OF THE INVENTION

1. Field of the Invention

The present invention relates to an image forming apparatus and a droplet discharge detecting method in the image forming apparatus.

2. Description of the Related Art

Generally, in inkjet recording devices, especially in a recording device provided with a head (linehead) as long as the width of paper, the head is not moved during printing and instead, a sheet of paper is conveyed directly beneath the head where ink is discharged onto the sheet so as to form an image thereon. In a printing method described above, when a nozzle is clogged and fails to discharge the ink, an image formation cannot be properly performed.

Thus, there is a need to dissolve clogging in a nozzle and hence, detection of a non-discharging state of a nozzle is performed first. Conventionally, there is a technology for detecting a nozzle in the non-discharging state (defect) by using a sensor formed by a pair of a laser diode (LD) and a photo diode (PD). Nozzles arranged in a row are caused to sequentially discharge ink droplets, and direct light or scattered light that appears when laser light emitted from the LD intersects the ink droplet is detected by the PD, thereby to detect a nozzle in the non-discharging state (defect).

Recent production of a high density and highly integrated head causes the time for detecting a nozzle defect to be increased significantly. In view of such a situation, Japanese Patent Application Laid-open No. 2006-110964, for example, discloses a technology that adopts a method for detecting a flying droplet either by tilting the direction of an optical axis of the detection light against the arrangement direction of the droplet discharging outlets and by performing control on the discharging timing of a droplet, or by performing control on a plurality of the nozzles in discharging droplets with shifted timing so that a plurality of droplets are kept in a state in which the droplets do not overlap each other within the cross section of the detection light. Accordingly, a plurality of droplets discharged from different droplet discharging outlets can be simultaneously detected, thereby achieving shortening of the detection time.

However, the conventional method for detecting a nozzle defect by having each nozzle discharge an ink droplet one by one has the problem in that it takes too much time in detecting the nozzle defect in a situation where a high density and highly integrated head is produced. The technology disclosed in Japanese Patent Application Laid-open No. 2006-110964 is capable of determining the number of ink droplets having been discharged simultaneously from a plurality of nozzles, but is incapable of determining which nozzle does have a defect.

Thus, there is a need to provide an image forming apparatus and a droplet discharge detecting method in the image forming apparatus capable of decreasing time needed for detecting a nozzle defect and further capable of identifying which nozzle does have the defect.

SUMMARY OF THE INVENTION

It is an object of the present invention to at least partially solve the problems in the conventional technology.

An image forming apparatus includes: a droplet discharging head that includes a plurality of nozzle rows each formed by a plurality of nozzles; a light emitting unit that irradiates a droplet with laser light emitted from a light emitting element in a direction intersecting a discharging direction of the droplet discharged from each of the nozzles of the droplet discharging head; a light-receiving unit that receives scattered light that is scattered when the droplet that has been discharged is irradiated by the laser light and outputs a signal corresponding to an amount of the scattered light; and a droplet discharge detecting unit that detects a droplet discharging status of each of the nozzles based on the signal output from the light-receiving unit. The laser light is emitted with an optical axis thereof that is shifted from middle between two adjacent nozzle rows; and the droplet discharge detecting unit selects from the droplet discharging head two nozzles adjacent in a direction intersecting another direction of the nozzle rows as detection target nozzles; and detects the droplet discharging status of each of the detection target nozzles based on the scattered light that is scattered when droplets are simultaneously discharged from the detection target nozzles.

A droplet discharge detecting method is implemented in an image forming apparatus that includes a droplet discharging head that includes a plurality of nozzle rows each formed by a plurality of nozzles, a light emitting unit that irradiates a droplet with laser light emitted from a light emitting element in a direction intersecting a discharging direction of the droplet discharged from each of the nozzles of the droplet discharging head, a light-receiving unit that receives scattered light that is scattered when the droplet that has been discharged is irradiated by the laser light and outputs a signal corresponding to an amount of the scattered light, and a droplet discharge detecting unit that detects a droplet discharging status of each of the nozzles based on the signal output from the light-receiving unit. The method includes: emitting the laser light with an optical axis thereof that is shifted from middle between two adjacent nozzle rows; and selecting, by the droplet discharge detecting unit, from the droplet discharging head two nozzles adjacent in a direction intersecting another direction of the nozzle rows as detection target nozzles; and detecting, by the droplet discharge detecting unit, the droplet discharging status of each of the detection target nozzles based on the scattered light that is scattered when droplets are simultaneously discharged from the detection target nozzles.

A computer program product includes a non-transitory computer-usable medium having a computer-readable program code embodied in the medium causing a computer to instruct an image forming apparatus that includes: a droplet discharging head that includes a plurality of nozzle rows each formed by a plurality of nozzles; a light emitting unit that irradiates a droplet with laser light emitted from a light emitting element in a direction intersecting a discharging direction of the droplet discharged from each of the nozzles of the droplet discharging head; a light-receiving unit that receives scattered light that is scattered when the droplet that has been discharged is irradiated by the laser light and outputs a signal corresponding to an amount of the scattered light; and a droplet discharge detecting unit that detects a droplet discharging status of each of the nozzles based on the signal output from the light-receiving unit to function as: the light emitting unit that emits the laser light such that an optical axis thereof is shifted from middle between two adjacent nozzle rows, and the droplet discharge detecting unit that selects from the droplet discharging head two nozzles adjacent in a direction intersecting another direction of the nozzle rows as detection target nozzles and that detects the droplet discharging status of each of the detection target nozzles based on the scattered light that is scattered when droplets are simultaneously discharged from the detection target nozzles.

The above and other objects, features, advantages and technical and industrial significance of this invention will be better understood by reading the following detailed description of presently preferred embodiments of the invention, when considered in connection with the accompanying drawings.

DETAILED DESCRIPTION OF THE PREFERRED EMBODIMENTS

An embodiment is described in detail below with reference to the attached drawings.

Figure 1:
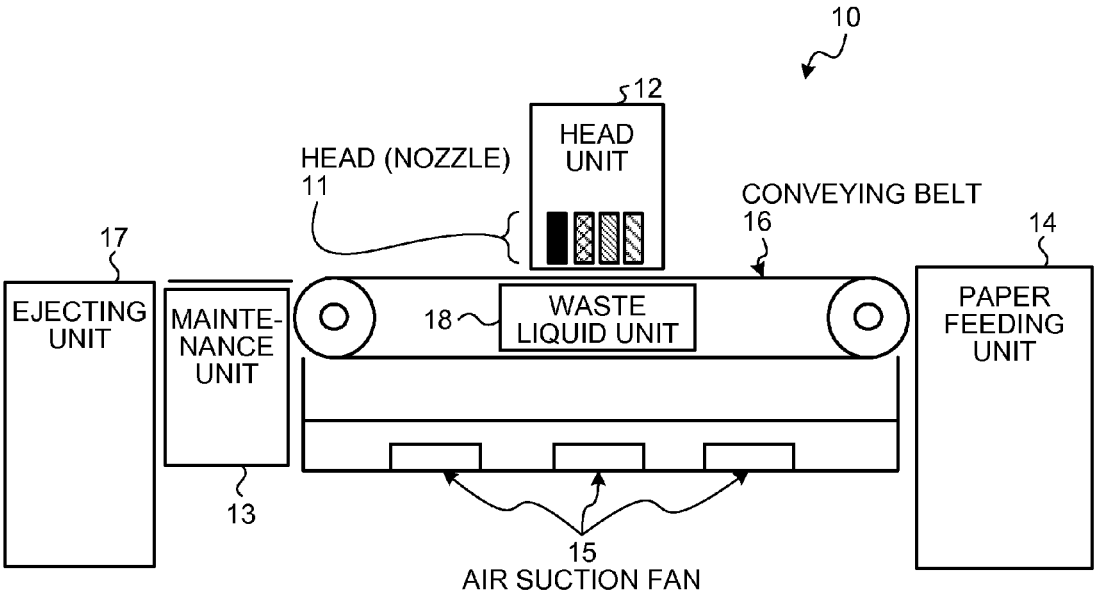
FIG. 1 is a diagram illustrating an overall schematic configuration of an inkjet recording device that includes a printing head provided along a line.

First, a schematic configuration of an inkjet recording device that includes a printing head provided along a line will be described with reference to FIG. 1. FIG. 1 is a diagram of an overall schematic configuration of an inkjet recording device having a printing head provided along a line.

An inkjet recording device 10 illustrated in FIG. 1 is also called a line printer. When printing, a plurality of print heads 11 (hereinafter referred to as heads 11) having a length that matches a printing width is fixed along a line to print on a recording sheet that has been conveyed thereto. In each of the heads 11, a plurality of nozzles for discharging ink is provided. The heads 11 mounted on a print head unit 12 (hereinafter referred to as a head unit 12) are usually provided in a staggered arrangement; however, a single unit as a linehead may be mounted instead thereon.

On the head unit 12, the heads 11 discharging ink of respective colors of yellow (Y), cyan (C), magenta (M), and black (Bk) are usually provided in a sheet conveying direction, and are mounted with an ink discharging direction facing downward. In the mean time, the number of ink colors and the arrangement order of the colors in the heads 11 with respect to the sheet conveying direction are not limited thereto.

The head unit 12 includes sub tanks (not illustrated) mounted thereon for supplying respective colors of ink to the heads 11. Each of the sub tanks for the corresponding color includes an ink supply tube through which ink is replenished from an ink cartridge (ink tank) mounted on a cartridge holder using a supply pump unit provided in the cartridge holder for transporting the ink in the ink cartridge (ink tank) thereto.

The head unit 12 of the inkjet recording device 10 usually stays in a standby mode with a cap placed thereon in a maintenance unit 13 for preventing ink in nozzle openings of the heads 11 from drying. When a user causes the inkjet recording device 10 to start printing, the head unit 12 removes the cap placed in the maintenance unit 13 and moves to the home position to start printing. The printing is usually performed at the home position at which the head unit 12 is kept fixed during printing. When the printing is finished and if the head unit 12 is to be capped, the head unit 12 moves to the maintenance unit 13 as a standby mode and the cap is placed thereon. When no printing is scheduled for a long time or the apparatus is to be turned off, the nozzle openings of the heads 11 are to be capped in the maintenance unit 13.

On a paper feeding unit 14 illustrated in FIG. 1, a paper feed tray for setting a sheet of paper is mounted. From the paper feed tray, the sheet of papers are separated and fed one by one. The paper feed tray is configured to adapt to an arbitrary paper size, and to detect the sheet of paper being set with a sensor so as to determine the size and an orientation (portrait or landscape) of the sheet. The sensor also detects when the paper feed tray is empty or an error in feeding the paper. During continuous printing, the gap between the successive sheets can be changed, and can be adjusted from time to time depending on the size or the conveying speed (printing speed) of the sheet.

After being fed, sheets of paper are conveyed one by one while being suctioned onto a conveying belt 16 for suction due to the negative pressure generated by an air suction fan 15. When the sheet passes by the head unit 12, each of the heads 11 discharges ink of the corresponding color onto the sheet so as to print letters or images thereon. The printed sheet is conveyed to an ejecting unit 17 and stacked on a paper discharge tray.

Although not illustrated in FIG. 1, a waste liquid unit 18 is provided in a predetermined position beneath the head unit 12 for storing therein waste ink produced by discharging ink in the absence of a recording sheet. The waste liquid unit usually includes a sensor that detects when the unit is full, and the user discards the waste liquid.

Figure 2:
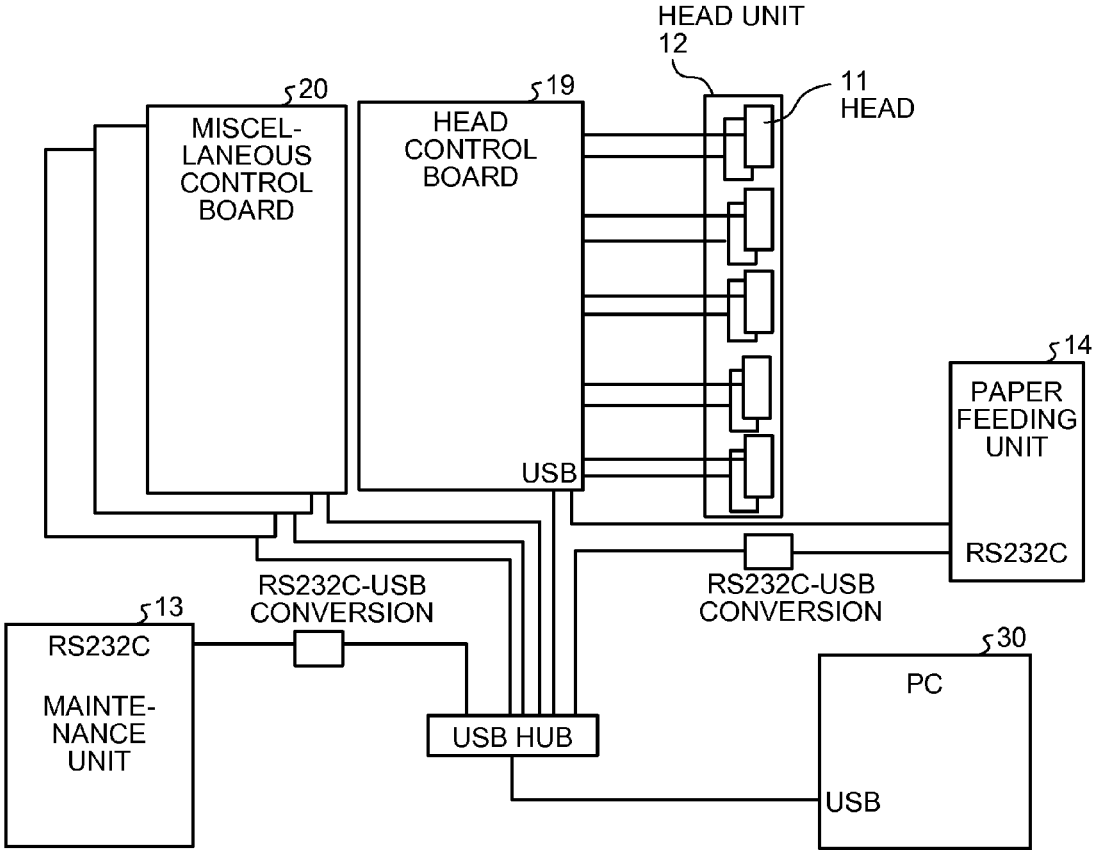
FIG. 2 is a diagram illustrating a configuration of an electric system included in the inkjet recording device according to an embodiment.

Next, a configuration of an electric system included in the inkjet recording device 10 of the present embodiment will be described with reference to FIG. 2. FIG. 2 is a diagram illustrating the configuration of the electric system of the inkjet recording device 10 according to the present embodiment.

The inkjet recording device 10 illustrated in FIG. 2 mainly includes the head unit 12 that controls the heads 11, the paper feeding unit 14 that feeds a sheet of paper from the paper feed tray and conveys the sheet, the maintenance unit 13 that performs maintenance and the like of the heads 11, a head control board 19 that controls the head unit 12, and a miscellaneous control board 20 that control various units.

The head control board 19 performs controls on each of the nozzles in the heads 11 based on print data from a PC 30 when and how much ink is to be discharge as ink droplets. The head control board 19 also controls discharge detection as described later. The head control board 19 and the miscellaneous control board 20 are control units equipped with a central processing unit (CPU) and a memory unit that includes a nonvolatile memory such as a flash memory or a volatile memory such as a dynamics random access memory (DRAM). A memory of the head control board 19 stores therein a control program to control the head unit 12 and a computer program to control a discharge detection unit as described later, for example.

Each unit is connected to the PC 30 that is an information processing device via a USB connection, through which data and commands are exchanged between the PC 30 and the each unit. In the inkjet recording device 10, although the paper feeding unit 14 and the maintenance unit 13 communicate with each other via RS232C, communication via RS232C is converted to communication through the USB connection for a standardization purpose. The conversion is done using a commercial conversion cable. By virtue of this, the PC 30 is capable of communicating with all the units via the USB connection, thereby enabling the PC 30 to recognize all the connected units as different USB devices for communication and control using the identification numbers.

The head unit 12 is configured such that each of the heads 11 is connected to and controlled by the head control board 19 via the USB connection and is further connected to the PC 30 via the USB HUB in an assembled manner. FIG. 2 illustrates that the single head control board 19 controls ten heads 11 provided along a line; however, depending on a print size or the like, the number of the heads 11 that the single head control board 19 can control is not limited to ten.

With the configuration described above, when the configuration of the heads 11 is to be changed, it is sufficient to connect a head control board 19 that is adaptable to the desired configuration via the USB connection thereto. When viewed from the PC 30 side, the head control board 19 that is newly connected is recognized as a USB device and hence can be used similarly as before.

In the present embodiment, a predetermined discrete signal is transmitted from the paper feeding unit 14 to the head control board 19 via parallel connection. Therefore, when a new head control board is to be added to the head control board 19, the newly added head control board is to be connected to the configuration in a parallel manner for receiving the discrete signal from the paper feeding unit 14.

Next, a discharge detecting unit of the inkjet recording device according to the present embodiment is described with reference to FIGS. 3 to 5.

Figure 3:
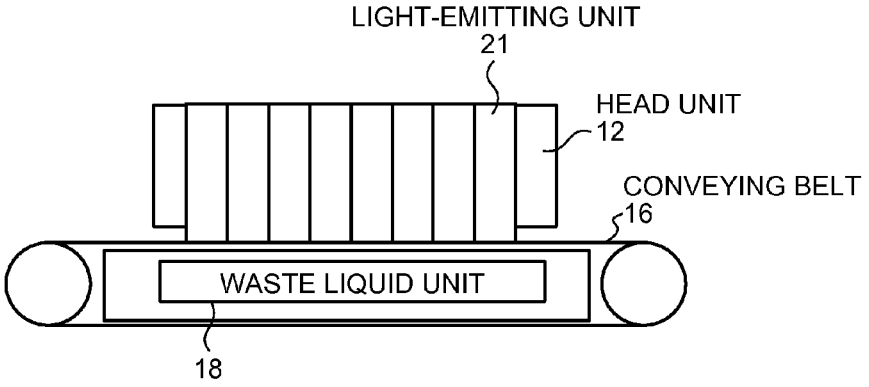
FIG. 3 is a schematic diagram illustrating a printing unit (overall configuration), in the inkjet recording device according to the present embodiment, viewed from a side of the printing unit that includes a discharge detecting unit located at a predetermined printing position of the inkjet recording device.

FIG. 3 is a schematic diagram illustrating a printing unit (overall configuration) of the inkjet recording device according to the present embodiment viewed from a side of the printing unit that includes a discharge detecting unit located in at a predetermined printing position of the inkjet recording device.

In the printing unit illustrated in FIG. 3, a discharge detecting unit is provided for each row of the heads. In FIG. 3, two discharge detecting units for each color, and eight discharge detecting units in total, are mounted on the printing units for detecting discharge of ink from nozzles of all the heads 11 thereby detecting a nozzle defect.

On both ends of each of the printing units, a light emitting unit 21 and a light-receiving unit (reference numeral 22 in FIG. 4) are mounted to form a discharge detecting unit for detecting discharge of ink from the corresponding printing unit. At a print position, a gap formed between the heads 11 and the conveying belt 16 is usually set to be about 1 mm. Discharge detection is performed in between the gap, and if it is safe to perform discharge detection immediately before printing, the conveying belt 16 is driven to convey the sheet of paper for printing. If discharge detection performed immediately before printing has detected a nozzle defect and the like, then the printing unit is moved to the maintenance position to perform a recovery operation on the particular head 11 or the nozzle in which the defect has been detected.

Figure 4:
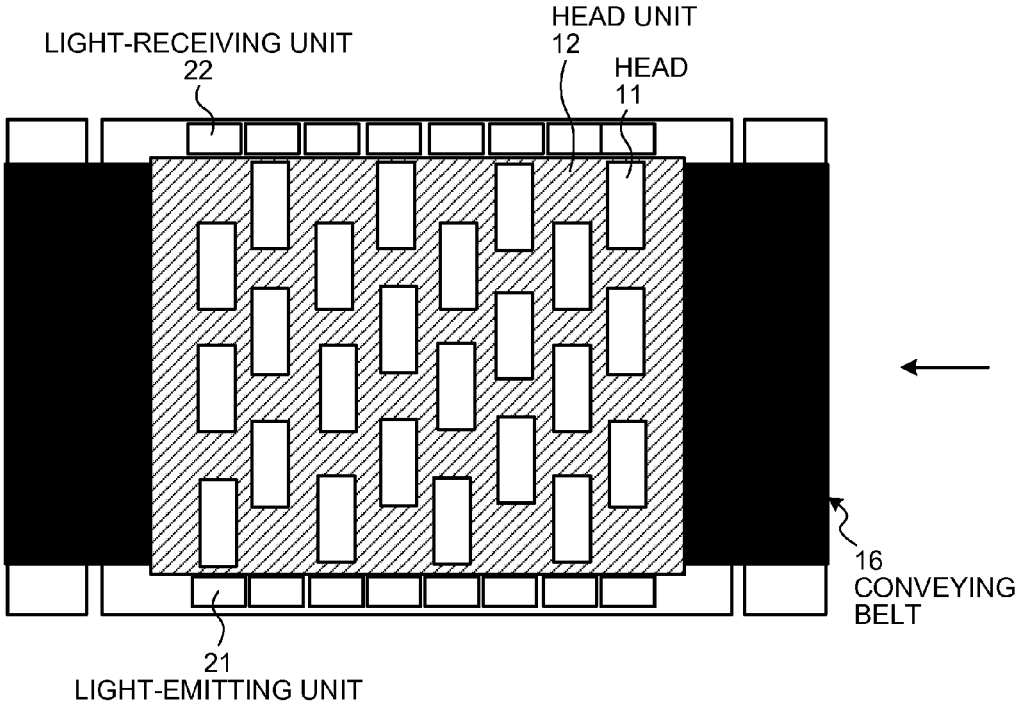
FIG. 4 is a schematic diagram illustrating the printing unit (overall configuration) of the inkjet recording device according to the present embodiment, viewed from the top of the printing unit that includes the discharge detecting unit in a predetermined printing position of the inkjet recording device.

FIG. 4 is a schematic diagram of the printing unit (overall) of the inkjet recording device according to the present embodiment illustrating the printing unit that includes the discharge detecting unit that is at a predetermined printing position of the inkjet recording device viewed from above.

On both ends of the printing unit illustrated in FIG. 4, the light emitting unit 21 and the light-receiving unit 22 for detecting discharge are mounted. The heads 11 are provided in a staggered arrangement on the printing unit, as illustrated in the drawing, and the discharge detecting unit is provided for each row of the heads 11.

The conveying belt 16 used in this embodiment includes holes for suctioning and conveying sheets of paper. The holes are usually arranged evenly, and in the present embodiment, detection of a nozzle defect is performed by controlling ink droplet discharge for discharge detection in synchronization with the movement of the holes of the conveying belt 16.

In the mean time, although not illustrated in the drawing, the maintenance position (a predetermined position on the maintenance unit 13) is a location where a recovery operation such as cleaning of the heads 11 is performed, and as described above, the maintenance unit 13 includes the cap that protects the heads 11 from drying or the like. The heads 11, when printing is not performed, are covered with the cap.

Figure 5:
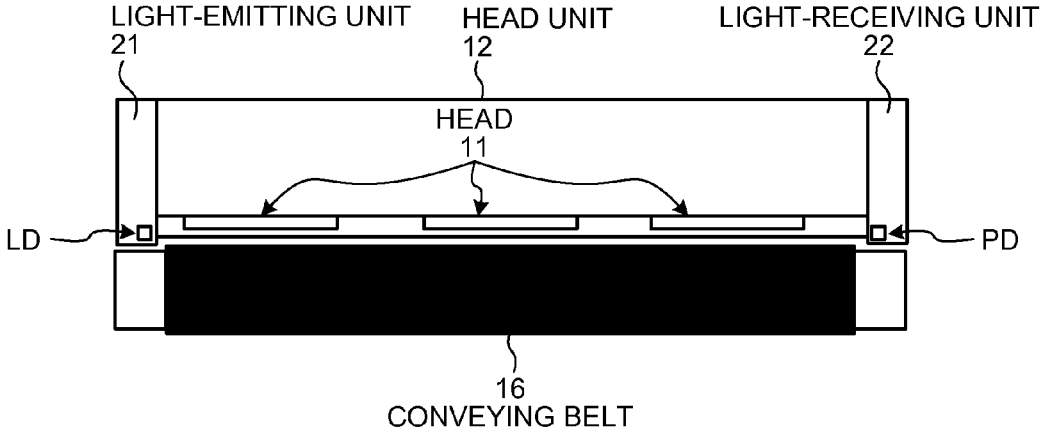
FIG. 5 is a schematic diagram illustrating the printing unit as a whole of the inkjet recording device according to the present embodiment viewed from the conveying direction of the printing unit that includes the discharge detecting unit in a predetermined printing position of the inkjet recording device.

FIG. 5 is a schematic diagram of the printing unit as a whole of the inkjet recording device according to the present embodiment viewed from a conveying direction of the printing unit that includes the discharge detecting unit in a predetermined printing position of the inkjet recording device. FIG. 5 illustrates a discharge detection state of the printing unit at a predetermined printing position.

On both ends of the printing unit, the light emitting unit 21 and the light-receiving unit 22 for detecting discharge are mounted. When the light emitting unit 21 and the light-receiving unit 22 are mounted on the printing unit, precise control on the adjustment of an optical axis is required, and a special jig or the like is usually used for the mounting. Laser light emitted from the LD of the light emitting unit 21 passes through the gap formed between the heads 11 and the conveying belt 16. Therefore, the laser light is emitted in the direction to intersect the direction of ink droplets discharged from each of the nozzles in the heads 11. The laser light irradiates the ink droplets discharged from the heads 11 to be scattered, and the scattered light is received by the PD of the light-receiving unit 22. In the mean time, the PD is provided in a position shifted from the optical axis of the laser light, as described later.

Next, the droplet discharge detection process in the inkjet recording device according to the present embodiment is described below.

Figure 6A:
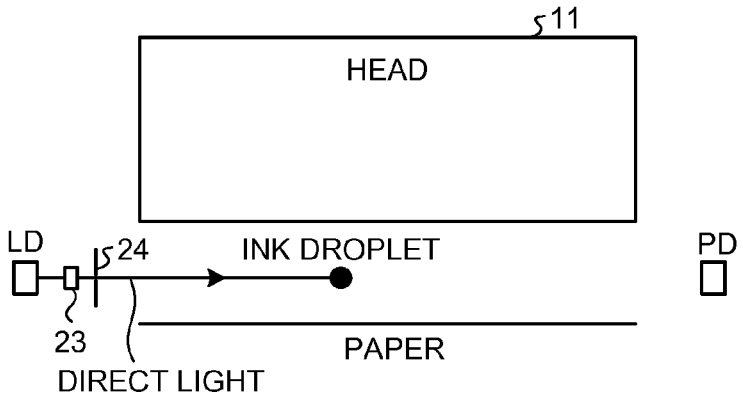
FIGS. 6A and 6B are explanatory diagrams illustrating a droplet discharge detection process in the inkjet recording device according to the present embodiment.
Figure 6B:
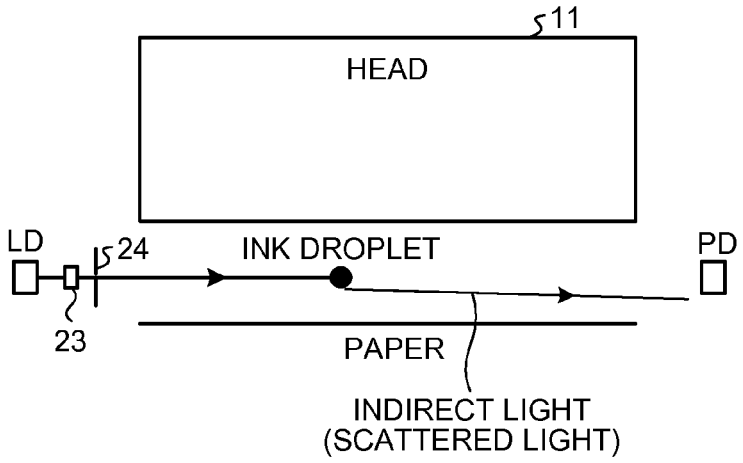

FIGS. 6A and 6B are diagrams that describe the droplet discharge detection process in the inkjet recording device according to the present embodiment.

A head 11 in FIGS. 6A and 6B includes a large number of nozzle openings depending on the resolution, and ink droplets are discharged from the nozzles. The size of an ink droplet can be changed by a drive waveform supplied to a piezoelectric element provided in the head 11. A large droplet is usually generated by merging several small droplets together.

Ink droplets are applied on a sheet of paper. A laser diode (LD) is provided in the light emitting unit so that the laser light can pass through a spacing (also called a gap) formed between a nozzle surface of the head 11 and the sheet of paper. In the vicinity of the LD, there are provided a collimator lens 23 for collecting the laser light and an aperture 24 for squeezing the beam diameter of the emitted light. The shape of the aperture 24 depends on the usage; however, the one with a circular hole is typically used.

On the optical axis of the laser light, a photo diode (PD) is provided as illustrated in FIGS. 6A and 6B. The PD converts an amount of light detected therein into an electric current, and various kinds of PD are used depending on the usage. The amount of light detected by the PD will be eventually converted into a voltage in an electronic circuit, and in general, the output level that is usually low is amplified using an operational amplifier or the like to a predetermined voltage level. Observing the waveform detected by the PD enables detection of an ink droplet electronically.

Methods for detecting an ink droplet include a direct method for directly observing laser light as illustrated in FIG. 6A; and an indirect method for observing indirect light (scattered light) scattered by the reflection of the laser light by the ink droplet as illustrated in FIG. 6B. The detection using direct light is usually performed based on a decrease in the output voltage level due to the droplet detection by the PD in the light-receiving side. The detection using indirect light is usually performed based on an increase in the output voltage level due to the droplet detection by the PD in the light-receiving side. When the droplet detection is performed using the indirect light, the PD is provided by being shifted from the optical axis of the laser light emitted therefrom. An output voltage level upon detecting a droplet is affected by the shifted position and the distance of the deviation of the PD.

As described above, an ink droplet can be detected using direct light or indirect light (scattered light); however, in the present embodiment, description is given below of the indirect light (scattered light) for detecting an ink droplet.

Figure 7:
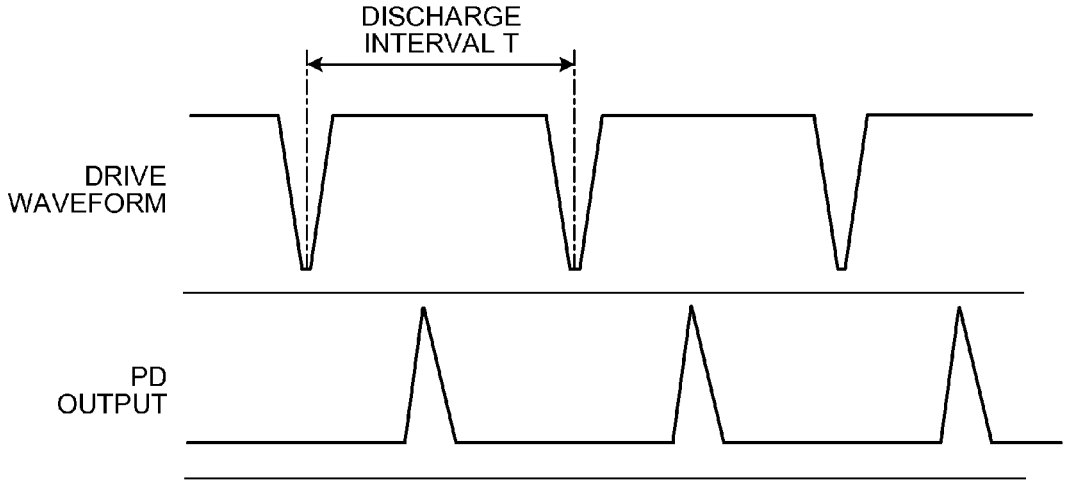
FIG. 7 is a diagram illustrating a drive waveform of a head (nozzle) and a detected waveform from discharging to detection of an ink droplet in a conventional inkjet recording device.

For reference, a drive waveform of a head (nozzle) and a detected waveform from discharging to detection of an ink droplet in the conventional inkjet recording device are illustrated in FIG. 7.

The piezoelectric element is included in the head 11 of the inkjet recording device 10 as described above. An ink droplet is discharged by controlling the drive waveform that drives the piezoelectric element. The drive waveform illustrated in FIG. 7 is a waveform for simply discharging a single ink droplet in a discharge interval T, which may be varied. An output waveform of the PD illustrated in FIG. 7 is the embodiment by using the indirect light (scattered light), in which the voltage level is detected when an ink droplet is detected. Thus, detection of a nozzle defect for each nozzle is performed by driving the head 11 to discharge the ink droplet and observing the output waveform of the PD.

Figure 8:
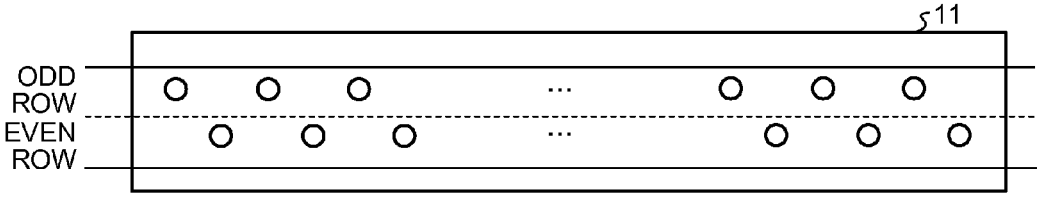
FIG. 8 is a diagram illustrating the head of the inkjet recording device according to the present embodiment viewed from a nozzle side.

FIG. 8 is a diagram of the head in the inkjet recording device according to the present embodiment viewed from the nozzle side.

As illustrated in the drawing, the head 11 includes two nozzle rows arranged in parallel to each other; the two nozzle rows are generally called an ODD row and an EVEN row, respectively. For the purpose of yielding a higher resolution, usually the two nozzle rows are relatively shifted to each other to yield a resolution doubled than before. In the present embodiment, discharged droplets from two nozzles of the two nozzle rows are to be detected simultaneously, the beam diameter of the laser light for discharge detection provided on the light-emitting side needs to have a width (beam diameter) capable of detecting the two rows. Furthermore, in order to create a difference in the detected waveform, the center of the optical axis of the laser light is shifted toward the EVEN row side. This makes use of the fact that an intensity of the scattered light varies according to the distances between the LD and the nozzles. By so doing, a difference in the voltage level of the detected waveform will be observed, thereby enabling determination on which one of the ODD row and the EVEN row includes a nozzle defect. In FIG. 8, the center of the optical axis is shifted toward the EVEN row; however, the determination of a nozzle defect can be performed by shifting the center of the optical axis toward the ODD row, too. In the mean time, the two nozzle rows are illustrated in FIG. 8; however, the head 11 may include more nozzle rows provided therein. In this case, the determination of a nozzle defect is performed for every two adjacent nozzle rows that do not overlap each other.

Figure 9:
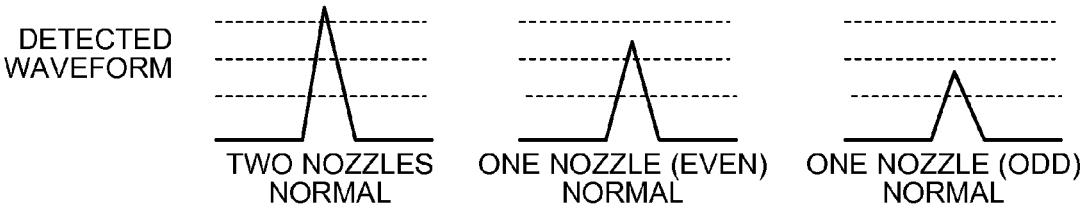
FIG. 9 is a diagram illustrating a detected waveform upon discharge detection in the inkjet recording device of the present embodiment.
Figure 10:
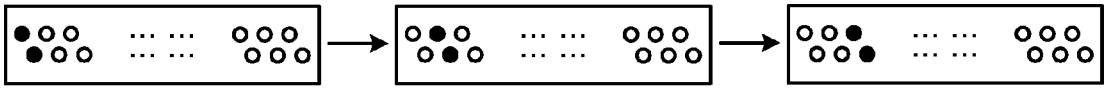
FIG. 10 is a diagram illustrating an order of discharging in the discharge detection of the inkjet recording device according to the present embodiment.
Figure 11:
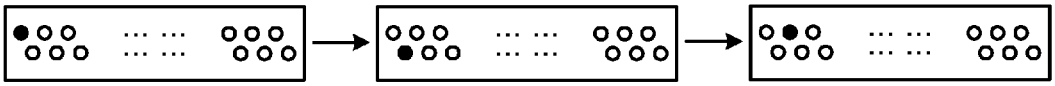
FIG. 11 is a diagram illustrating an example of an order of discharging droplets in a case where a single droplet is discharged at a time when discharge detection is performed in a conventional inkjet recording device.

FIG. 9 is a diagram illustrating a detected waveform upon discharge detection in the inkjet recording device of the present embodiment. FIG. 10 is a diagram illustrating an order of discharging in the discharge detection of the inkjet recording device according to the present embodiment. FIG. 11 is a diagram illustrating an example of an order of discharging droplets in a case where a single droplet is discharged at a time when discharge detection is performed in a conventional inkjet recording device.

As illustrated in FIG. 8, the head 11 of the present embodiment includes two nozzle rows (ODD row and EVEN row) that are disposed in parallel to each other. Then, as illustrated in FIG. 10, two adjacent nozzles in the direction that intersects the nozzle row direction provided on an end of the heads 11 are selected as detection target nozzles, and are caused to discharge droplets. Then the next two nozzles are selected and caused to discharge droplets. As such, two adjacent nozzles are selected and caused to discharge droplets simultaneously until another end of the heads 11 is reached. The detected waveform upon simultaneous discharging from two adjacent nozzles is used for determining whether a nozzle defect has occurred.

In the present embodiment, the two nozzle rows are subjected for simultaneous detection. The left panel in FIG. 9 illustrates the waveform that is to be detected if two nozzles discharge ink droplets properly. If one of the two nozzles has a defect and only one nozzle discharges ink droplets, determination will be made on which one of the two nozzles has the defect based on the voltage level of the detected waveform. The intensity of the scattered light varies according to the distances between the LD and the nozzles. In FIG. 9, the optical axis is shifted toward the EVEN row, and therefore the voltage of the detected waveform caused by a discharged droplet from the nozzle in the EVEN row will be larger than the voltage of the detected waveform due to the ODD row. As such, the difference in the voltage levels of the detected waveforms enables the determination on whether or not any one of the two nozzles discharges. Specifically, a threshold is set and the determination is made based on whether the voltage level exceeds the threshold, and nozzle defects in the two nozzles are individually detectable by observing a single detected waveform. In the mean time, FIG. 10 illustrates an example of discharge detection on a single head; however, detection of a nozzle defect can be performed even when a plurality of heads 11 are arranged in a linehead as illustrated in FIG. 4 by detecting discharge for a number of times equal to the number of the heads 11. FIG. 10 illustrates the detection method of a nozzle defect by sequentially selecting two adjacent nozzles in the head 11 as detection target nozzles from one end to the other end; however, the order of selecting the detection target nozzles is not limited thereto.

For reference, FIG. 11 illustrates an example of a conventional method of discharge detection by selecting one nozzle at a time from one end of the head 11 for performing discharging from the nozzle. In this case, the center of the optical axis does not need to be shifted, so that the detected waveform shows a constant value (see FIG. 7). In this method, a time period for the detection is proportional to the number of nozzles provided on the head 11, and especially in a case such as a linehead that includes a large number of the heads 11, the discharge detection takes a longer time and is therefore inefficient. In the present embodiment, even with the same number of nozzles as before, a nozzle defect is detectable by causing two nozzles to discharge droplets simultaneously, and therefore, a time period needed for discharge detection is halved compared with the conventional case where a single nozzle is caused to discharge droplets at a time.

Figure 12:
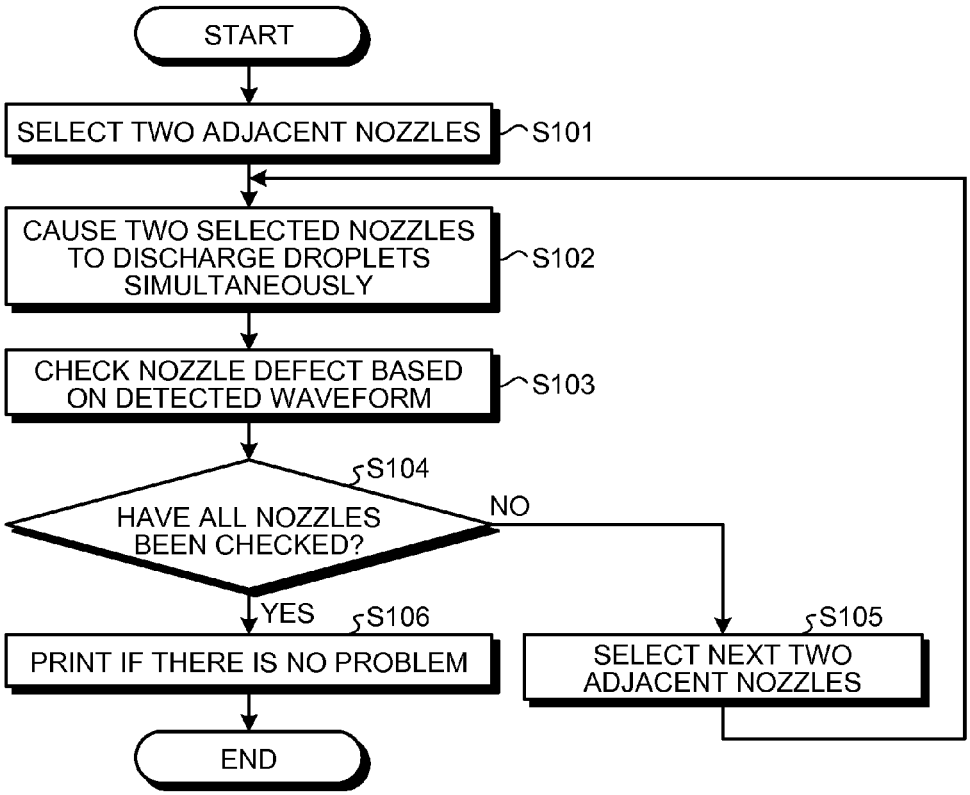
FIG. 12 is an operational flowchart for discharge detection in the inkjet recording device of the present embodiment.

Next, an operation during the discharge detection in the inkjet recording device of the present embodiment is described with reference to FIG. 12. FIG. 12 is an operational flowchart of the discharge detection in the inkjet recording device of the present embodiment. The head control board 19 controls the operation during the discharge detection.

First, two adjacent nozzles on one end of two nozzle rows are selected (Step S101).

Next, the two nozzles that have been selected are caused to discharge droplets simultaneously (Step S102).

On the basis of a detected waveform detected by the discharge detecting unit, a nozzle defect is checked as described before (Step S103).

Next, if not all the nozzles have been checked (No at Step S104), the process proceeds to Step S105 to select the next two adjacent nozzles, and then returns to Step S102, where it is checked if the two nozzles that have been sequentially selected discharge ink droplets so as to check the presence of a nozzle defect for all the nozzles.

When all the nozzles have been checked (Yes at Step S104), the process proceeds to Step S106, and if no problem has been found, i.e., if no nozzle defect has been found, printing is executed. If a problem has been found in the head unit 12, as described before, the head unit 12 is moved to the maintenance position in the maintenance unit 13 where a recovery operation such as cleaning of the heads 11 is executed.

The inkjet recording device 10 and the method for detecting discharge of an ink droplet according to the present embodiment have been described in detail. In the present embodiment, when detecting an ink droplet discharged from the head 11 that includes two nozzle rows provided in parallel therein, two adjacent nozzles are caused to discharge ink droplets simultaneously, and a nozzle defect is detected based on the voltage level of a detected waveform. Even with the same number of nozzles, a nozzle defect is detectable in two nozzles that discharge droplets simultaneously, and therefore, a time period needed for discharge detection is halved compared with the conventional case where a single nozzle is caused to discharge an ink droplet at a time. Furthermore, deviation of the center of the optical axis of the laser light from the middle between the nozzle rows enables determination on which one of the ODD row and the EVEN row includes a nozzle defect.

Meanwhile, a control program or another computer program for executing the discharge detection in the image forming apparatus of the present embodiment may be incorporated in advance by being provided on a NV-RAM, ROM, or other nonvolatile storage media equipped with the image forming apparatus, or may be written on a CD-ROM, flexible disk (FD), CD-R, digital versatile disk (DVD) or other computer-readable recording media in the format of an installable or executable file.

The above-mentioned programs may be stored on a computer connected to a network such as the Internet to be provided or distributed through downloading via the network.

According to the embodiment, a nozzle defect is detected based on a scattered light caused by droplets discharged simultaneously from two nozzles that are adjacent to each other in a direction that intersects a direction along adjacent nozzle rows, thereby decreasing a time needed for detecting the nozzle defect. Furthermore, because the optical axis of laser light for discharge detection is shifted away from the middle between the two adjacent nozzle rows, the difference in the nozzle rows appears as a difference in the intensity of the scattered light, thereby enabling to detect which nozzle does have a defect.

Although the invention has been described with respect to specific embodiments for a complete and clear disclosure, the appended claims are not to be thus limited but are to be construed as embodying all modifications and alternative constructions that may occur to one skilled in the art that fairly fall within the basic teaching herein set forth.

What is claimed is:

1. An image forming apparatus comprising:

a droplet discharging head that includes a plurality of nozzle rows, each of the plurality of nozzle rows being formed by a plurality of nozzles;

a light emitting unit configured to emit a laser light from a light emitting element in a direction substantially parallel to the plurality of nozzle rows, the direction intersecting a discharge direction of a droplet discharged from each of the plurality of nozzles of the droplet discharging head;

a light-receiving unit configured to, receive scattered light that is scattered when the droplet that has been discharged is irradiated by the laser light, and output a signal corresponding to an amount of the scattered light; and a droplet discharge detecting unit configured to detect a droplet discharging status of each of the plurality of nozzles based on the output signal from the light-receiving unit, wherein the laser light is emitted so that a center of an optical axis of the laser light is shifted from a center position between two adjacent ones of the plurality of nozzle rows; and the droplet discharge detecting unit is configured to, select from the droplet discharging head two of the plurality of nozzles that are adjacent in a direction intersecting another direction of the plurality of nozzle rows, as detection target nozzles, and detect the droplet discharging status of each of the detection target nozzles based on the scattered light that is scattered when droplets are simultaneously discharged from the detection target nozzles.

2. The image forming apparatus according to claim 1, wherein the laser light emitted from the light emitting unit has a beam diameter configured to detect droplets discharged from ones of the plurality of nozzles in two adjacent ones of the plurality of nozzle rows.

3. The image forming apparatus according to claim 1, wherein the droplet discharge detecting unit is configured to sequentially select two adjacent nozzles from the plurality of the nozzle rows as the detection target nozzles and causes the two adjacent nozzles that have been selected at a time to discharge droplets simultaneously, thereby detecting the droplet discharging statuses of all the nozzles in the droplet discharging head.

4. The image forming apparatus according to claim 1, wherein, the droplet discharge detecting unit is configured to iteratively, select two adjacent nozzles as the detection target nozzles from nozzles on one end of the plurality of nozzle rows to nozzles on another end of the plurality of nozzle rows, and detect the droplet discharging status of each of the detection target nozzles, thereby detecting the droplet discharging statuses of all of the plurality of nozzles.

5. The image forming apparatus according to claim 1, wherein the droplet discharge detecting unit is configured to determine whether each one of the detection target nozzles discharges a droplet based on the output signal from the light-receiving unit and a plurality of thresholds.

6. A droplet discharge detecting method implemented in an image forming apparatus, the image forming apparatus including a droplet discharging head that includes a plurality of nozzle rows, each of the plurality of nozzle rows being formed by a plurality of nozzles, the method comprising:

emitting a laser light from a light emitting element in a direction substantially parallel to the plurality of nozzle rows, the direction intersecting a discharge direction of a droplet discharged from each of the plurality of nozzles of the droplet discharging head, the laser light being emitted so that a center of an optical axis of the laser light is shifted from a center position between two adjacent ones of the plurality of nozzle rows;

receiving scattered light that is scattered when the droplet that has been discharged is irradiated by the laser light;

outputting a signal corresponding to an amount of the scattered light;

detecting a droplet discharging status of each of the plurality of nozzles based on the output signal;

selecting from the droplet discharging head two of the plurality of nozzles that are adjacent in a direction intersecting another direction of the plurality of nozzle rows as detection target nozzles; and detecting the droplet discharging status of each of the detection target nozzles based on the scattered light that is scattered when droplets are simultaneously discharged from the detection target nozzles.

7. The droplet discharge detecting method in the image forming apparatus according to claim 6, wherein the laser light emitted from the light emitting unit has a beam diameter capable of detecting droplets discharged from ones of the plurality of nozzles in two adjacent ones of the plurality of nozzle rows.

8. The droplet discharge detecting method in the image forming apparatus according to claim 6, wherein the selecting sequentially selects two adjacent nozzles from the plurality of nozzle rows as the detection target nozzles and causes the two adjacent nozzles that have been selected at a time to discharge droplets simultaneously, thereby detecting the droplet discharging statuses of all of the plurality nozzles in the droplet discharging head.

9. The droplet discharge detecting method in the image forming apparatus according to claim 6, wherein the selecting iteratively, selects two adjacent nozzles as the detection target nozzles from nozzles on one end of the plurality of nozzle rows to nozzles on another end of the plurality of nozzle rows, and detects the droplet discharging status of each of the detection target nozzles, thereby detecting the droplet discharging statuses of all of the plurality of nozzles.

10. The droplet discharge detecting method in the image forming apparatus according to claim 6, further comprising:

determining whether each one of the detection target nozzles discharges a droplet based on the output signal from the light-receiving unit and a plurality of thresholds.

11. A non-transitory computer readable medium including a computer program product, the computer program product comprising a computer-readable program code, which when executed by a computer, causes the computer to perform functions including:

irradiating a laser light from a light emitting element in a direction substantially parallel to a plurality of nozzle rows of a droplet discharging head, each of the plurality of nozzle rows being formed by a plurality of nozzles, the direction intersecting a discharge direction of a droplet discharged from each of the plurality of nozzles of the droplet discharging head, the light being emitted so that a center of an optical axis of the laser light is shifted from a center position between two adjacent ones of the plurality of nozzle rows;

receiving scattered light that is scattered when the droplet that has been discharged is irradiated by the laser light;

outputting a signal corresponding to an amount of the scattered light;

detecting a droplet discharging status of each of the plurality of nozzles based on the output signal;

selecting from the droplet discharging head two of the plurality of nozzles that are adjacent in a direction intersecting another direction of the plurality of nozzle rows as detection target nozzles; and detecting the droplet discharging status of each of the detection target nozzles based on the scattered light that is scattered when droplets are simultaneously discharged from the detection target nozzles.

12. The non-transitory computer readable medium according to claim 11, wherein the execution of the computer-readable program code, causes the computer to emit the laser light having a beam diameter capable of detecting droplets discharged from ones of the plurality of nozzles in the two adjacent ones of the plurality of nozzle rows.

13. The non-transitory computer readable medium according to claim 11, wherein the execution of the computer-readable program code, causes the computer to, sequentially select two adjacent nozzles from the plurality of nozzle rows as the detection target nozzles, and cause the two adjacent nozzles that have been selected at a time to discharge droplets simultaneously, thereby detecting the droplet discharging statuses of all the nozzles in the droplet discharging head.

14. The non-transitory computer readable medium according to claim 11, wherein the execution of the computer-readable program code, causes the computer to iteratively, select two adjacent nozzles as the detection target nozzles from nozzles on one end of the plurality of nozzle rows to nozzles on another end of the plurality of nozzle rows, and detect the droplet discharging status of each of the detection target nozzles, thereby detecting the droplet discharging statuses of all of the plurality of nozzles.

15. The non-transitory computer readable medium according to claim 11, wherein the execution of the computer-readable program code, causes the computer to determine whether each one of the detection target nozzles discharges a droplet based on the output signal from the light-receiving unit and a plurality of thresholds.

* * * * *